US010683654B2

(12) United States Patent
Priester

(10) Patent No.: US 10,683,654 B2
(45) Date of Patent: Jun. 16, 2020

(54) ADJUSTABLE FLOOR DRAIN

(71) Applicant: Jay R. Smith Mfg. Co., Montgomery, AL (US)

(72) Inventor: Donald E. Priester, Deatsville, AL (US)

(73) Assignee: Smith Industries, Inc., Montgomery, AL (US)

( * ) Notice: Subject to any disclaimer, the term of this patent is extended or adjusted under 35 U.S.C. 154(b) by 0 days.

(21) Appl. No.: 16/161,363

(22) Filed: Oct. 16, 2018

(65) Prior Publication Data

US 2019/0119896 A1 Apr. 25, 2019

Related U.S. Application Data

(60) Provisional application No. 62/575,840, filed on Oct. 23, 2017, provisional application No. 62/660,771, filed on Apr. 20, 2018.

(51) Int. Cl.
*E03F 5/04* (2006.01)

(52) U.S. Cl.
CPC .... *E03F 5/0407* (2013.01); *E03F 2005/0413* (2013.01)

(58) Field of Classification Search
CPC ..... E03F 5/0407; E03F 2005/0413
See application file for complete search history.

(56) References Cited

U.S. PATENT DOCUMENTS

| | | | | |
|---|---|---|---|---|
| 3,874,006 | A * | 4/1975 | Ritter | E03C 1/264 4/629 |
| 4,910,811 | A * | 3/1990 | Izzi, Sr. | E03C 1/262 210/163 |
| 5,921,282 | A | 7/1999 | Castillo et al. | |
| 6,076,559 | A | 6/2000 | Castillo et al. | |
| 7,735,512 | B1 | 6/2010 | Ismert et al. | |
| 8,043,497 | B2 * | 10/2011 | Silverstein | E03F 5/0407 210/164 |
| 8,347,424 | B2 * | 1/2013 | Wroblewski | E03F 5/0407 137/362 |
| 8,347,906 | B1 | 1/2013 | Ismert et al. | |
| 9,428,900 | B2 | 8/2016 | Wroblewski et al. | |
| 2015/0292662 | A1 | 10/2015 | Majocka et al. | |

(Continued)

OTHER PUBLICATIONS

Zurn Specification Sheet for "5 Inch Top Assembly Adjustable Floor Drain with EZ1 Technology" dated Jun. 1, 2017.

(Continued)

*Primary Examiner* — Kevin F Murphy
(74) *Attorney, Agent, or Firm* — Eric J. Sosenko; Jonathan P. O'Brien; Honigman LLP

(57) ABSTRACT

A floor drain assembly for connecting to a drain system of an installation site. The floor drain assembly includes a drain body having drain coupling adapted for connecting to the drain system, a collar mounted to the drain body, and a rough-in adapter having a radially extending flange. The rough-in adapter is axially adjustably mounted to the collar and a strainer frame is axially adjustably mounted to the rough-in adapter. Mounted to the frame is a strainer. A cover encloses the strainer and strainer frame and includes a central region and a downwardly extending perimetric wall that is removably mounted, at a lower end thereof to, the flange of the rough-in adapter.

19 Claims, 12 Drawing Sheets

(56) References Cited

U.S. PATENT DOCUMENTS

| | | | | |
|---|---|---|---|---|
| 2017/0130442 | A1 | 5/2017 | Brooks et al. | |
| 2018/0073237 | A1 * | 3/2018 | Say | E03F 5/041 |

OTHER PUBLICATIONS

Zurn Specification Sheet for "Body Assembly with Type B Strainer and Ez1 Technology" dated Jun. 1, 2017.
Zurn Specification Sheet for "5 Inch Top Assembly Adjustable Floor Cleanout with EZ1 Technology" dated Apr. 6, 2017.
Zurn Specification Sheet for "Floor Cleanout with Type B cover and EZ1 Technology" dated May 31, 2017.
Zurn Advertisement from Plumbing Engineer Magazine, Annual Spotlight Issue, Jul. 2017.
Wade Specification Sheet for "Floor Drain with Round Adjustable Top—Slotted Grate".

* cited by examiner

ADJUSTABLE FLOOR DRAIN

CROSS REFERENCE TO RELATED APPLICATIONS

This non-provisional patent application claims benefit of U.S. Application No. 62/575,840 filed Oct. 23, 2017, and claims benefit of U.S. Application No. 62/660,771 filed Apr. 20, 2018, which are hereby incorporated by reference in their entirety.

BACKGROUND

1. Field of the Invention

The present invention generally relates to floor drains intended to be installed in a poured concrete floor. More specifically, the present invention relates to a vertically adjustable floor drain that is intended to be installed with a poured concrete floor about it.

2. Description of Related Art

Floor drains are installed in buildings and other installation sites so that liquid, such as water, which gets deposited on the floor, can be quickly and easily drained off of the floor preventing damage to the floor surface or other structural aspects of the building/installation site. Since the floor drain is installed in a poured concrete floor, the floor drain must be precisely located and aligned with the finished grade so as to not pose a tripping hazard and to ensure proper operation of the floor drain.

SUMMARY

Accordingly, in one aspect of the invention, an adjustable floor drain assembly is provided with a cover that may be removed after installation of the floor drain at the installation site.

In one aspect of the invention, a floor drain assembly is provided for connecting to a drain system of an installation site, and the floor drain assembly includes a drain body having outlet coupling adapted for connecting to the drain system and defining an axis; a collar mounted to the drain body; a rough-in adapter having a radially extending flange, the rough-in adapter being axially adjustably mounted to the collar; a drain head axially adjustably mounted to the rough-in adapter; and a cover positioned over the drain head and including a central region and a downwardly extending perimetric wall, the perimetric wall being removably engaged at a lower end thereof to the flange of the rough-in adapter.

In a further aspect, the cover is engaged with the flange of the rough-in adapter at an outer perimeter of the flange.

In an additional aspect, the cover extends about an outer perimeter of the flange of the rough-in adapter.

In still another aspect, the engagement of the cover with the flange includes one or more resilient members.

In yet a further aspect, the one or more resilient members are resilient toothed tabs.

According to an additional aspect, the tabs are located on one of the flange and the collar.

In yet an additional aspect, the tabs engage recesses on the other of the flange and the collar.

The floor drain assembly according to claim 1, wherein the engagement of the cover to the flange is a form fit mated engagement.

According to another aspect, the mated engagement includes a rib received within a groove.

In a further aspect, the rib is formed on the flange and the groove is formed on the cover.

In an additional aspect, the rib extends in a circumferential direction about the perimeter of one of the flange and the cover.

In still another aspect, the rib extends in a circumferential direction about a least a portion of the perimeter of one of the flange and the cover.

According to yet a further aspect, the rib extends in a circumferential direction about the entire perimeter of one of the flange and the cover.

In yet an additional aspect, the cover is retainingly engaged with the flange along the entire outer perimeter of the flange.

In another aspect, the cover includes a tool engagement recess formed in the central region.

In still a further aspect, the cover includes a tool engagement recess formed adjacent to an outer perimeter of the central region.

In an additional aspect, the cover is transparent.

According to a further aspect, the cover is semi-transparent.

In another aspect, the cover is wholly transparent.

Further objects, features and advantages of this invention will become readily apparent to persons skilled in the art after review of the following description, including the claim, with reference to the drawings that are appended to and form a part of this specification.

DETAILED DESCRIPTION

As used in the description that follows, directional terms such as "upper" and "lower" are used with reference to the orientation of the elements as presented in the figures. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part whether or not such an access is designated in the figures. An axial surface is therefore one that faces in the axial direction. In other words, an axial surface faces in a direction along the central axis. A radial surface therefore faces radially, generally away from or toward the central axis. It will be understood, however, that in actual implementation, the directional references used herein may not necessarily correspond with the installation and orientation of the corresponding components or device.

Figure 1:
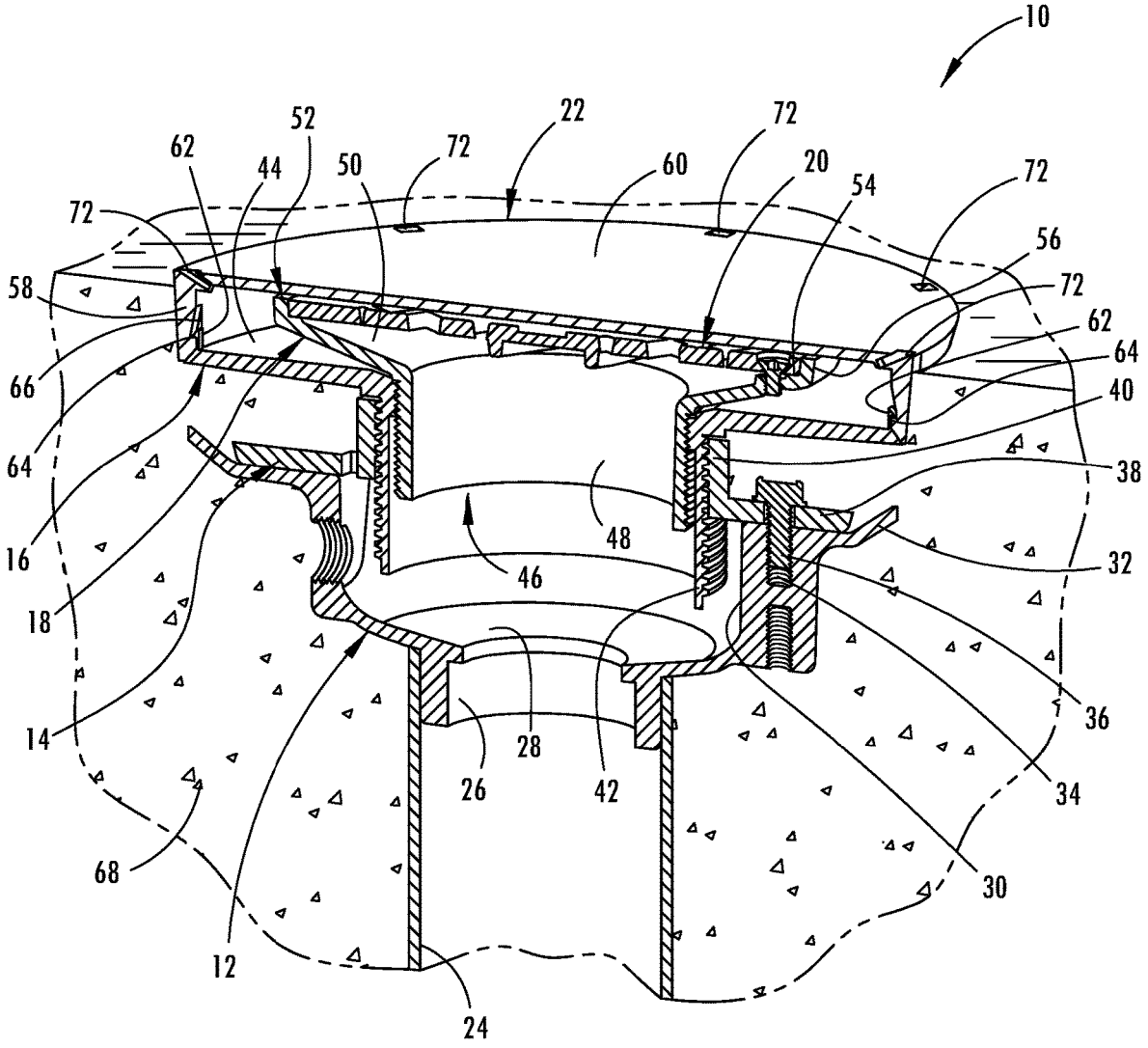
FIG. 1 is a cross-sectional view of a floor drain assembly embodying the principles of the present invention with a construction cover in place on the floor drain assembly.

Referring now to the drawings, a floor drain assembly embodying the principles of the present invention is generally illustrated in FIG. 1 and designated at 10. The floor drain assembly 10 includes, as its principal components, a drain body 12, a collar 14 mounted to the drain body 12, a rough-in adapter 16 mounted to the collar 14, a strainer frame 18 mounted to the rough-in adapter 16, a strainer 20 mounted to the strainer frame 18, and a construction cover 22 cooperating with the rough-in adapter 16 to enclose the strainer 20 and the strainer frame 18.

Figure 2:
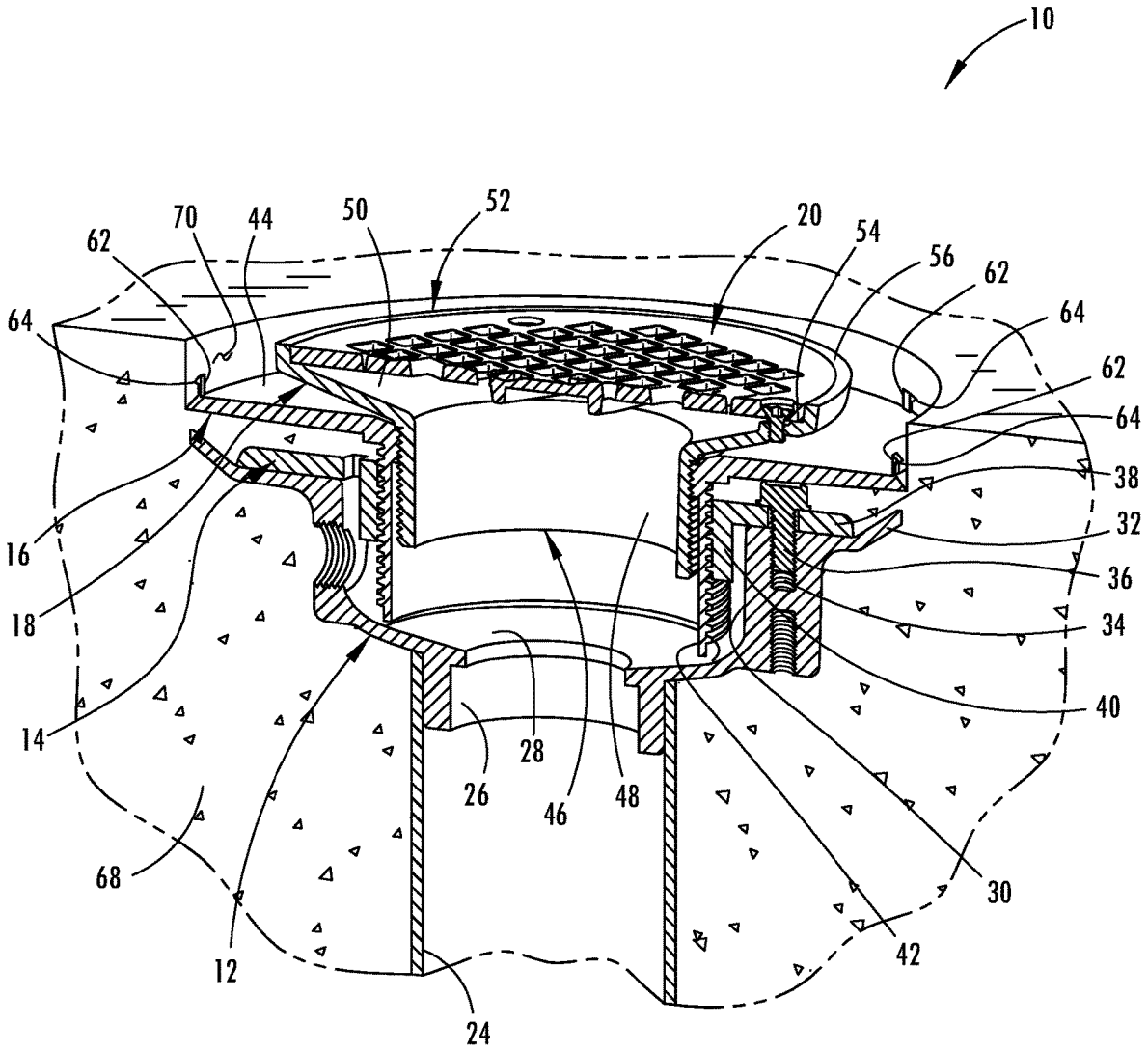
FIG. 2 is a cross-sectional view of the floor drain assembly seen in FIG. 1 with the construction cover removed and the assembly in its shortest height adjusted position.

As seen in FIGS. 1 and 2, the floor drain assembly 10 engages with a drain pipe 24 of the drain system of the building or installation site. More specifically, the drain body 12 includes a centrally located and axially extending outlet coupling 26, which extends from a bottom wall 28 and is to be received within the open end of the drain pipe 24. The drain body 12 further includes a cylindrical sidewall 30 axial extending upward from the bottom wall 28 so as to define a receptacle cavity within the drain body 12. At the upper end of the sidewall 30, drain body 12 is further provided with a radially outward extending flange 32. The flange 32 includes a top surface in which are provided one or more threaded bores 34 that receive correspondingly threaded fasteners 36 so as to mount the collar 14 to the drain body 12. Accordingly, the collar 14 includes a radial flange 38 sized to be received on the flange 32 of the drain body 12 and is provided with bores or slots through which the threaded fasteners 36 may be inserted for engagement with the threaded bores 34 of the flange 32 of the drain body 12.

At the radially inward extent of the flange 38 of the collar 14, the collar 14 is provided with an axially extending and internally threaded shank 40. The outer diameter of the shank 40 is preferably less than the inner diameter defined by the cylindrical sidewall 30 of the drain body 12. Provided with this reduced diameter of the shank 40, the collar 14 may be mounted on to the drain body 12 with the shank 40 either extending upward (as seen in FIG. 1) or downward (as seen in FIG. 2). As will be appreciated from the following discussion, mounting the collar 14 with the shank 40 in the upward position affords the drain assembly 10 its tallest height adjusted position. Conversely, mounting the collar 14 with the shank 40 and the downward position provides the drain assembly 10 with shorter height adjusted positions.

The rough-in adapter 16 is also provided with an axially extending shank 42 and a radially extending flange 44. The shank 42 is externally threaded and of a diameter allowing the shank 42 of the adapter 16 to be threadably received within the shank 40 of the collar 14. At the upper end of the shank 42, adjacent to the radial flange 44, the shank 42 is internally provided with a threaded portion. This internally threaded portion of the rough-in adapter 16 receives the drain head 46, which is comprised of the strainer frame 18 and the strainer 20 in floor drain assemblies of FIGS. 1-6.

Figure 3:
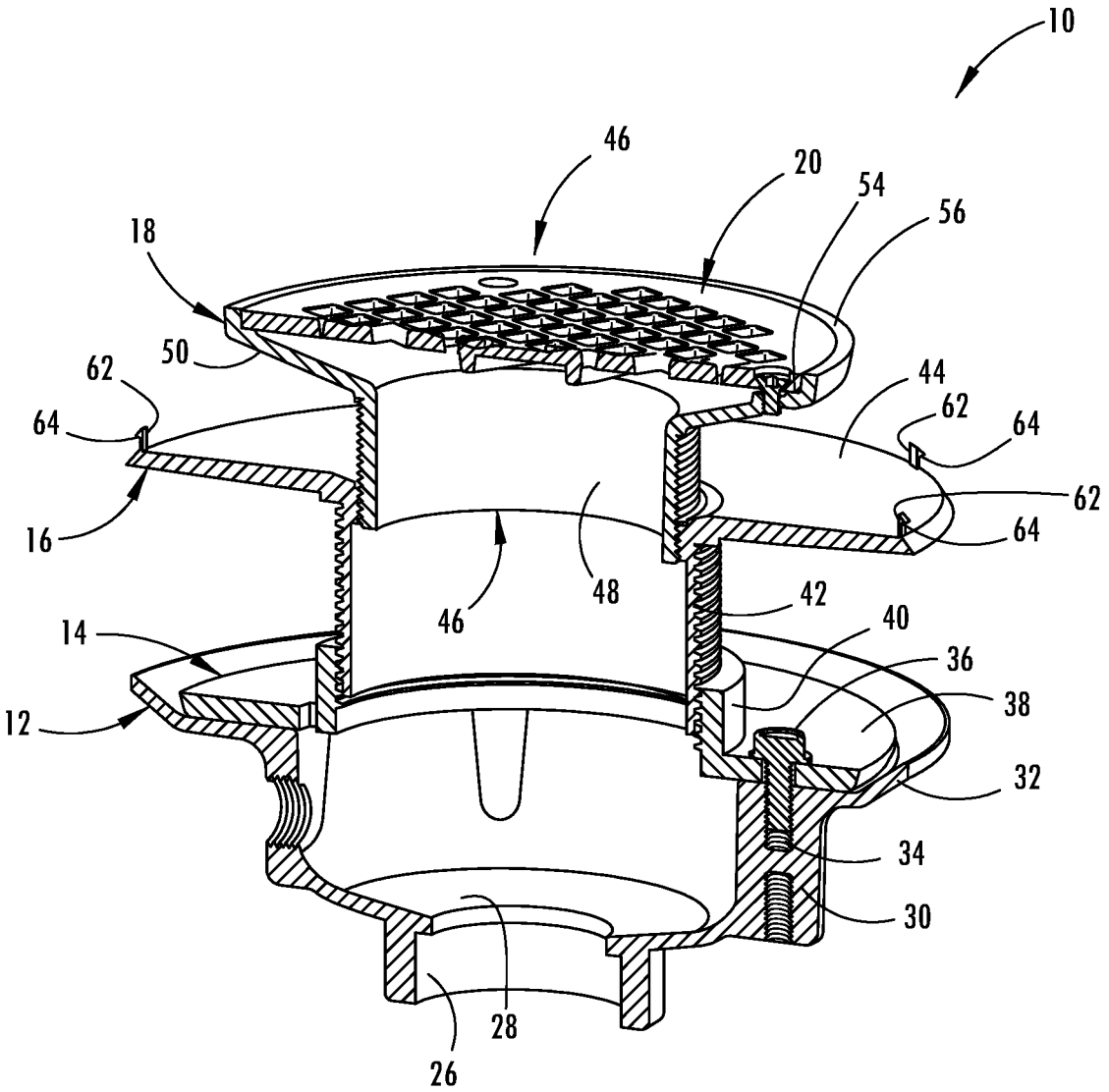
FIG. 3 is a cross-sectional view of the floor drain assembly seen in FIG. 1 with the construction cover removed and the assembly in its tallest height adjusted position.
Figure 4:
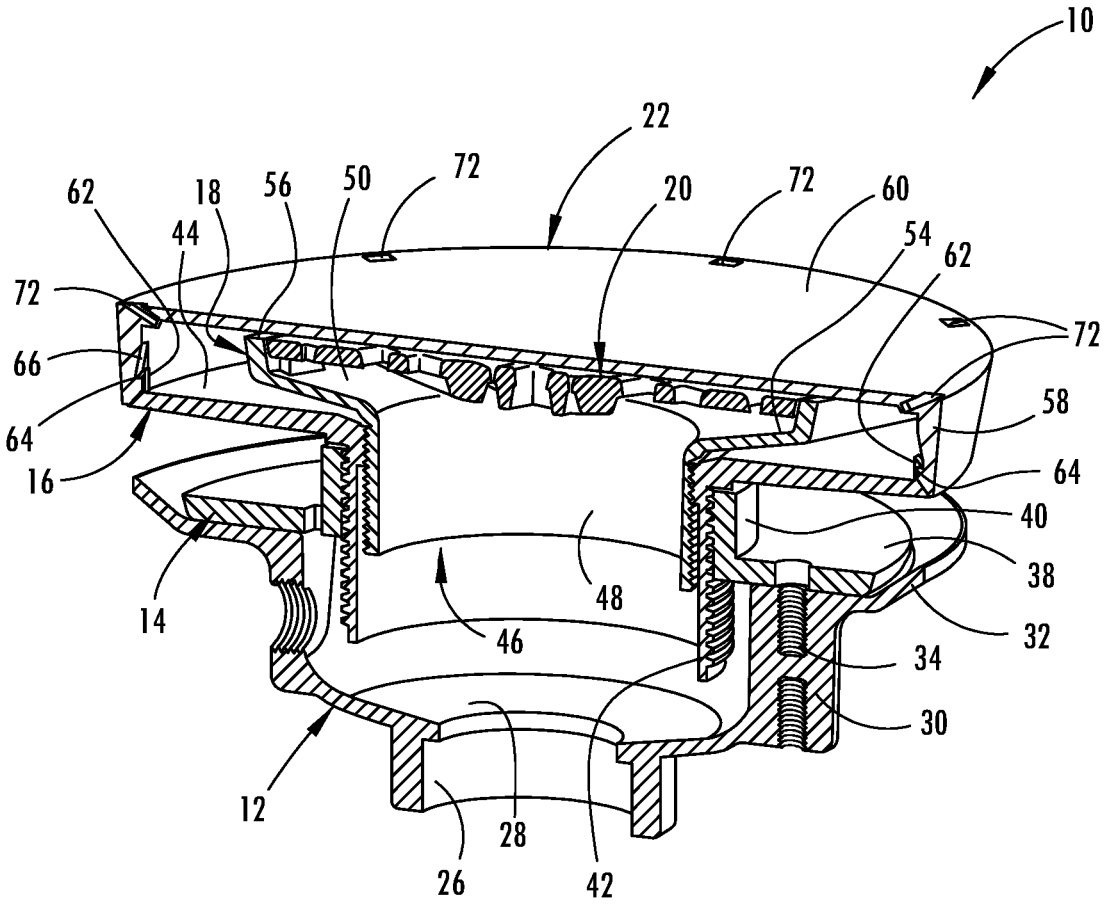
FIG. 4 is a cross-sectional view of a floor drain assembly, similar to that seen in FIG. 1, but having a strainer frame adapted for receipt of a square strainer instead of a round strainer.
Figure 5:
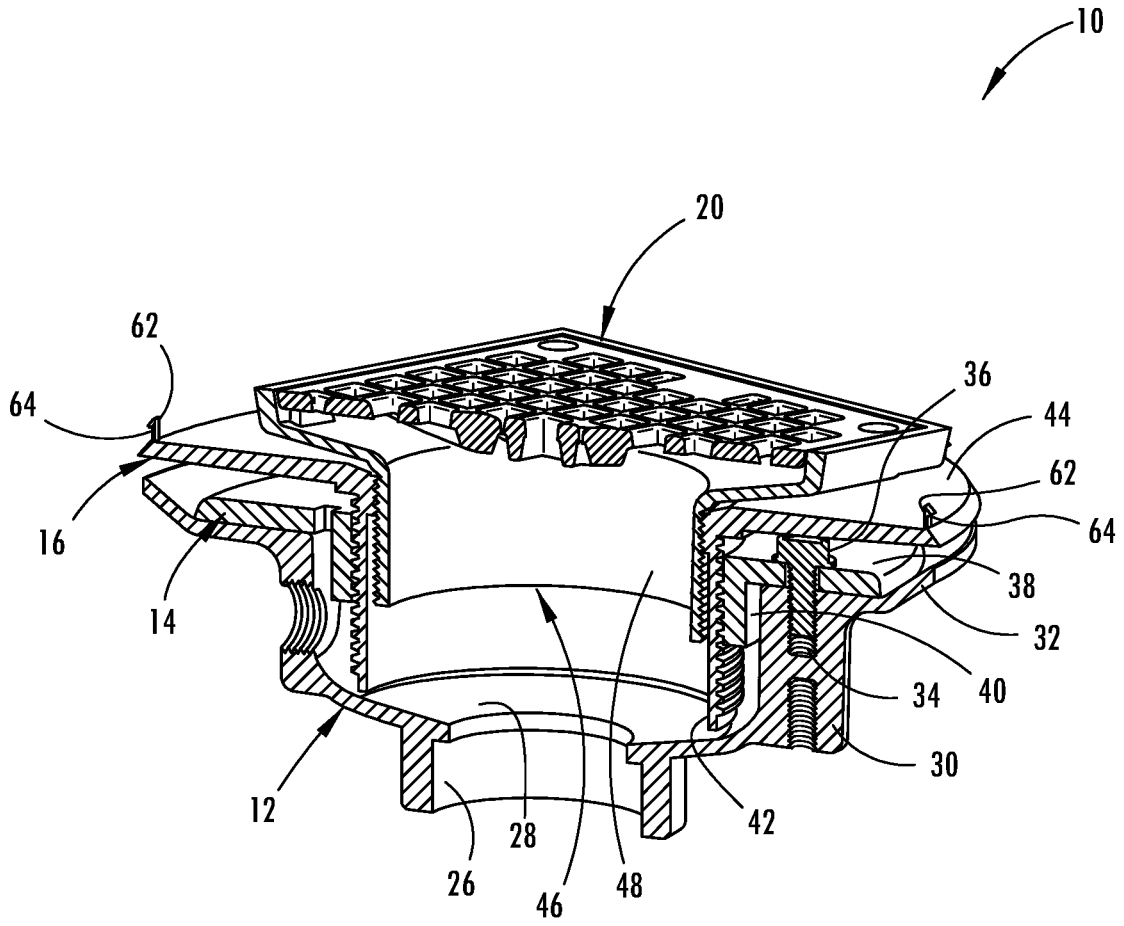
FIG. 5 is a cross-sectional view of the floor drain assembly seen in FIG. 4 with the construction cover removed and the assembly in its shortest height adjusted position.
Figure 6:
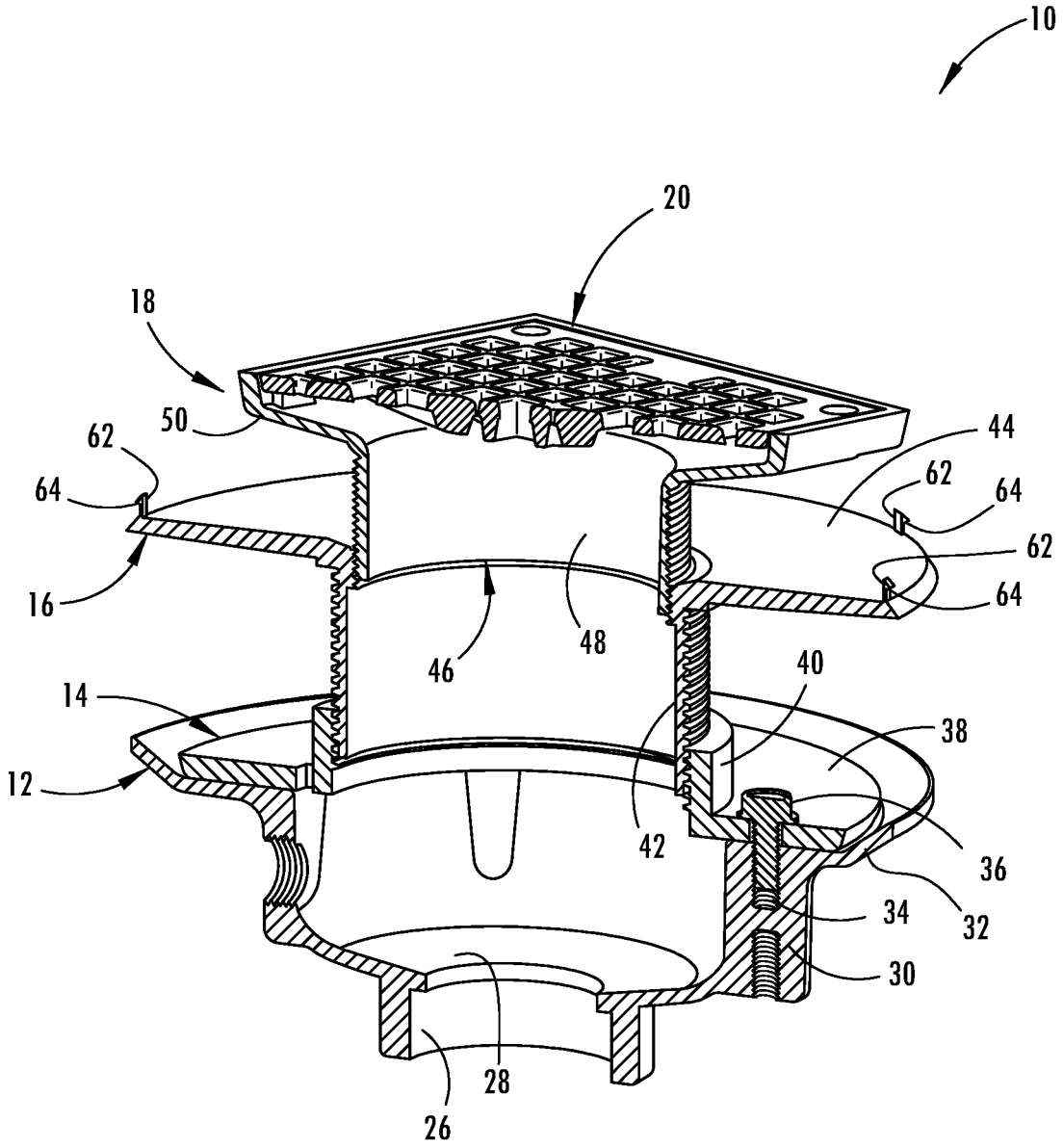
FIG. 6 is a cross-sectional view of the floor drain assembly seen in FIG. 4 with the construction cover removed and the assembly in its tallest height adjusted position.

The strainer frame 18 engages the rough-in adapter 16 through a shank 48 provided with external threads corresponding to the internally threaded portion of the rough-in adapter 16. To receive and direct water through the floor drain assembly 10, a funnel portion 50 extends outwardly and at least slightly upwardly from the upper extent of the shank 48 of the strainer frame 18. Provided at the outer perimeter of the funnel portion 50 is a rim 52. The rim 52 may define any desired shape for the drain head 46 including, without limitation, a round configuration (as seen in FIGS. 1-3) or a square configuration (as seen in FIGS. 4-6). The rim 52 includes both a flat 54 and an adjacent lip 56, with the lip 56 extending axially. These features, the flat 54 and lip 56, cooperate to receive the strainer 20 within the strainer frame 18. More specifically, the strainer 20 is received on the flat 54 inside of the lip 56. To fixedly mount the strainer 20 to the strainer frame 18, the flat 54 is provided with threaded bores that receive threaded fasteners extending through corresponding bores in the strainer 20. Alternately, other retaining mechanisms may be employed.

As previously mentioned, the rough-in adapter 16 includes a radially extending flange 44. This flange 44 extends outwardly beneath the funnel portion 50 of the strainer frame 18 a distance such that the outer extent or perimeter of the flange 44 is radially beyond the outer extent or perimeter of the lip 56, as measured from a central axis extending upwardly through the drain pipe 24, outlet coupling 26, shank 42 of the rough-in adapter 16 and shank 48 of the strainer frame 18.

The drain head 46 is enclosed within the floor drain assembly 10 by engagement of the construction cover 22 with the rough-in adapter 16. More specifically, the construction cover 22 includes a perimetric sidewall 58 that extends downwardly from a generally planar top wall 60, the latter of which has a shape substantially corresponding to the shape of the perimeter of the flange 44. About its perimeter, the flange 44 is attached to the perimetric sidewall 58, thereby securing the construction cover 22 to the rough-in adapter 16.

Attachment of the perimetric sidewall 58 to the flange 44 can be achieved in a variety of ways. In one preferred construction, the flange 44 is provided with a resilient, tabs 62 at spaced apart locations about the perimeter of the flange 44. The tabs 62 extend upwardly and are provided with an outwardly stepped tooth 64 at their distal ends. At locations corresponding to the tabs 62, the inner surface of the perimetric sidewall 58 is provided with recesses 66. These recesses 66 are shaped, such as with an undercut, so as to receive therein the teeth 64 of the tabs 62 and retain the lower edge of the perimetric sidewall 58 in engagement with the perimeter of the flange 44.

During pouring of a concrete subfloor 68, the floor drain assembly 10 is positioned on the drain pipe 24 and the height of the rough-in adapter 16 is adjusted such that the top of the subfloor 68, once poured, will correspond to a location along the height of the perimetric sidewall 58. As seen in FIG. 1, the top of the subfloor 68 is at a location that is approximately one half the height of the perimetric sidewall 58. Notably, the top of the subfloor 68 may correspond to the upper edge of the perimetric sidewall 58, in other words the upper surface of the top wall 60, but should not extend there over.

Once the subfloor 68 has cured, the construction cover 22 is designed to be removed from the remainder of the floor drain assembly 10 and, in particular, disengaged from the rough-in adapter 16. After removing the construction cover 22, a gap 70 as seen in FIG. 2 between the outer edge of the drain head 46 (the lip 56) and the subfloor 68 is revealed. The gap 70 allows for manipulation of the drain head 46 relative to the rough-adapter 16 whereby the drain head 46 may be raised to a height corresponding with the yet to be installed finished floor. By rotating the drain head 46, the threaded engagement between the shank 48 of the strainer frame 18 and the inner portion of the shank 42 of the rough-in adapter 16 will cause raising or lowering of the drain head 46, depending on the direction of rotation.

To enable removal of the construction cover 22, the top wall 60 is formed with slots 72 at locations corresponding to the recesses 66 and the tabs 62. The slots 72 are of a size and shape allowing for the insertion of a tool, such as a screwdriver. By manipulating the tool in the slot 72, the recesses 66 can be caused to disengage from the teeth 64 of the tabs 62. For example, a screwdriver (not shown) inserted into the slot 72 may be leveraged outwardly over a block (not shown) causing the associated region of the perimetric sidewall 58 to deform inwardly and upwardly whereby the tooth 64 of the resilient tab 62 is pulled out of the recess 66. This process can then be repeated until the entire construction cover 22 can be removed.

Once the height of the drain head 46 is adjusted, the finish floor may be installed and the gap 70 may be filled in with grout or another appropriate material.

As seen in FIG. 1, the collar 14 is installed such that the shank 40 extends upwardly. This provides a certain minimum height for the strainer 20 when the subfloor is installed. If a reduced height is required, the collar 14 is installed such that the shank 40 extends downwardly into the drain body 12, which is illustrated in FIG. 2. As seen in FIG. 3, by adjusting the relative engagement between the shanks 40, 42 and 48 wide variety of heights can be accommodated in the present construction.

Referring now to FIGS. 4-6, these figures have identical construction to that of FIGS. 1-3 with the exception of the drain head. In FIGS. 4-6 the drain head is provided with a square shape as opposed around shape. Features of the drain head are otherwise the same. For this reason, the various components of the floor drain assembly 10 seen in FIGS. 4-6 are identified with the same reference numerals as the corresponding components of FIGS. 1-3.

Figure 7:
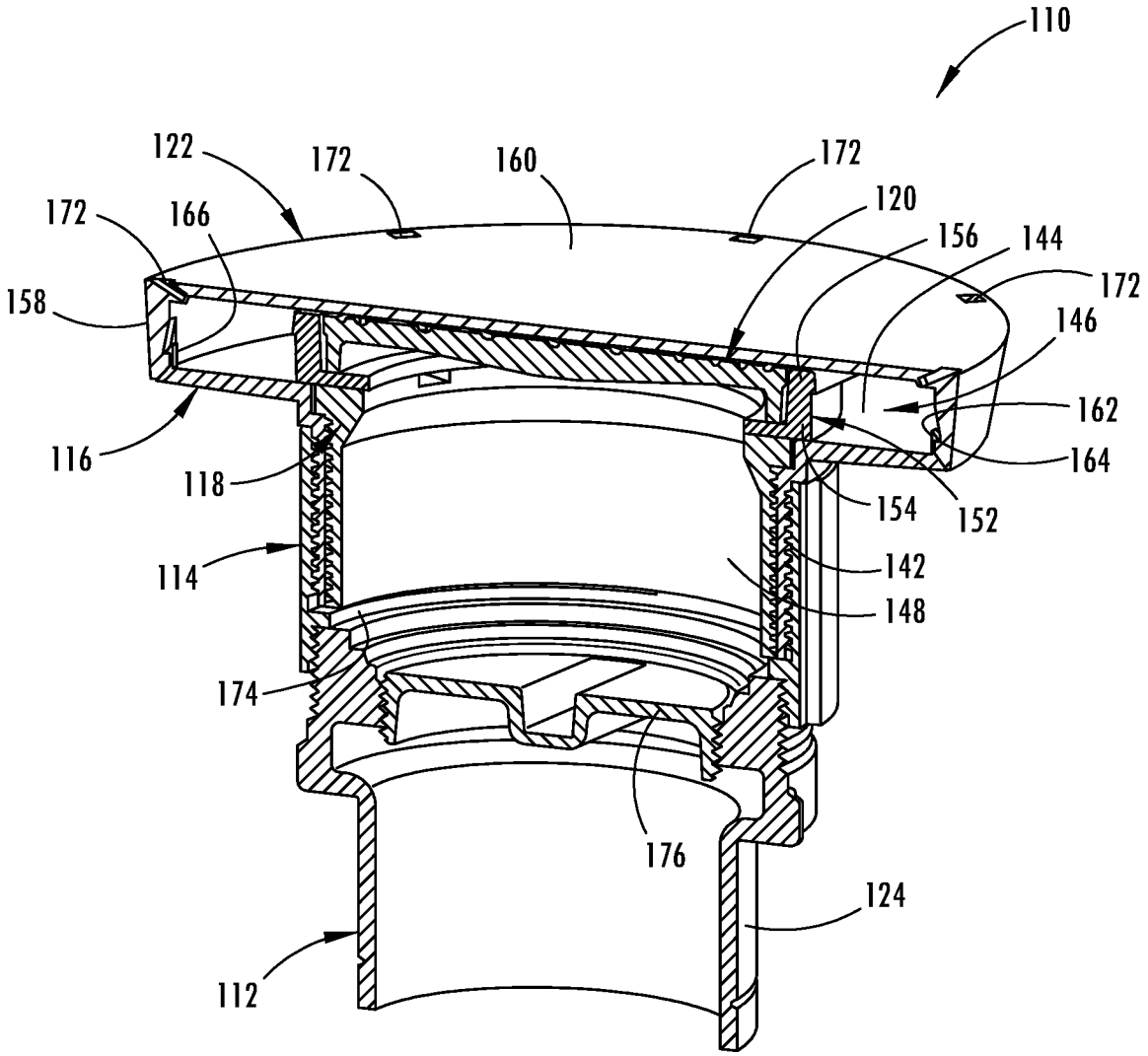
FIG. 7 is a cross-sectional view of an assembly, provided as a modular adjustable cleanout assembly, embodying the principles of the present invention and having the construction cover in place on the floor drain assembly.
Figure 8:
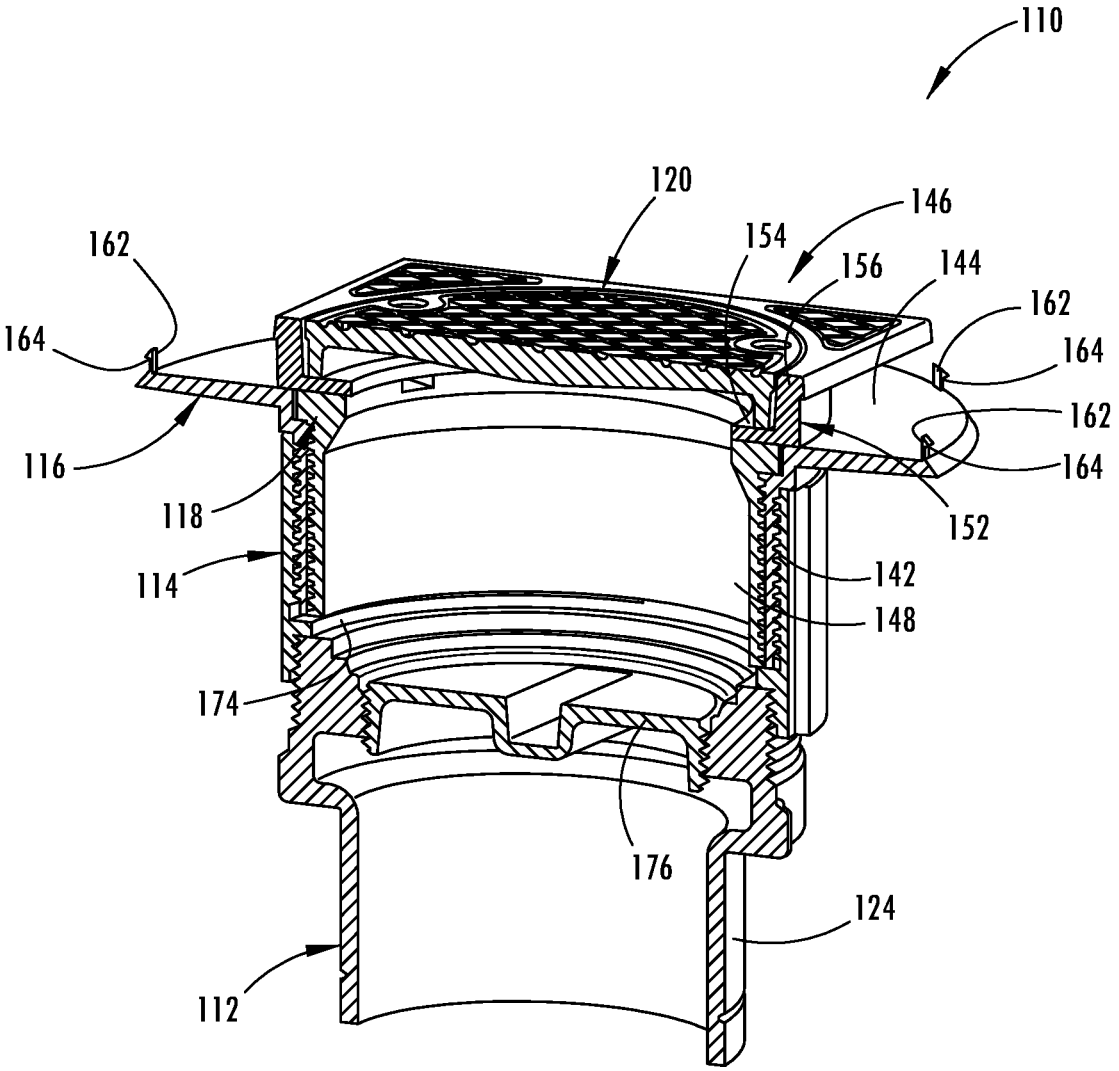
FIG. 8 is a cross-sectional view of the cleanout assembly seen in FIG. 7 with the construction cover removed and the assembly in its shortest height adjusted position.
Figure 9:
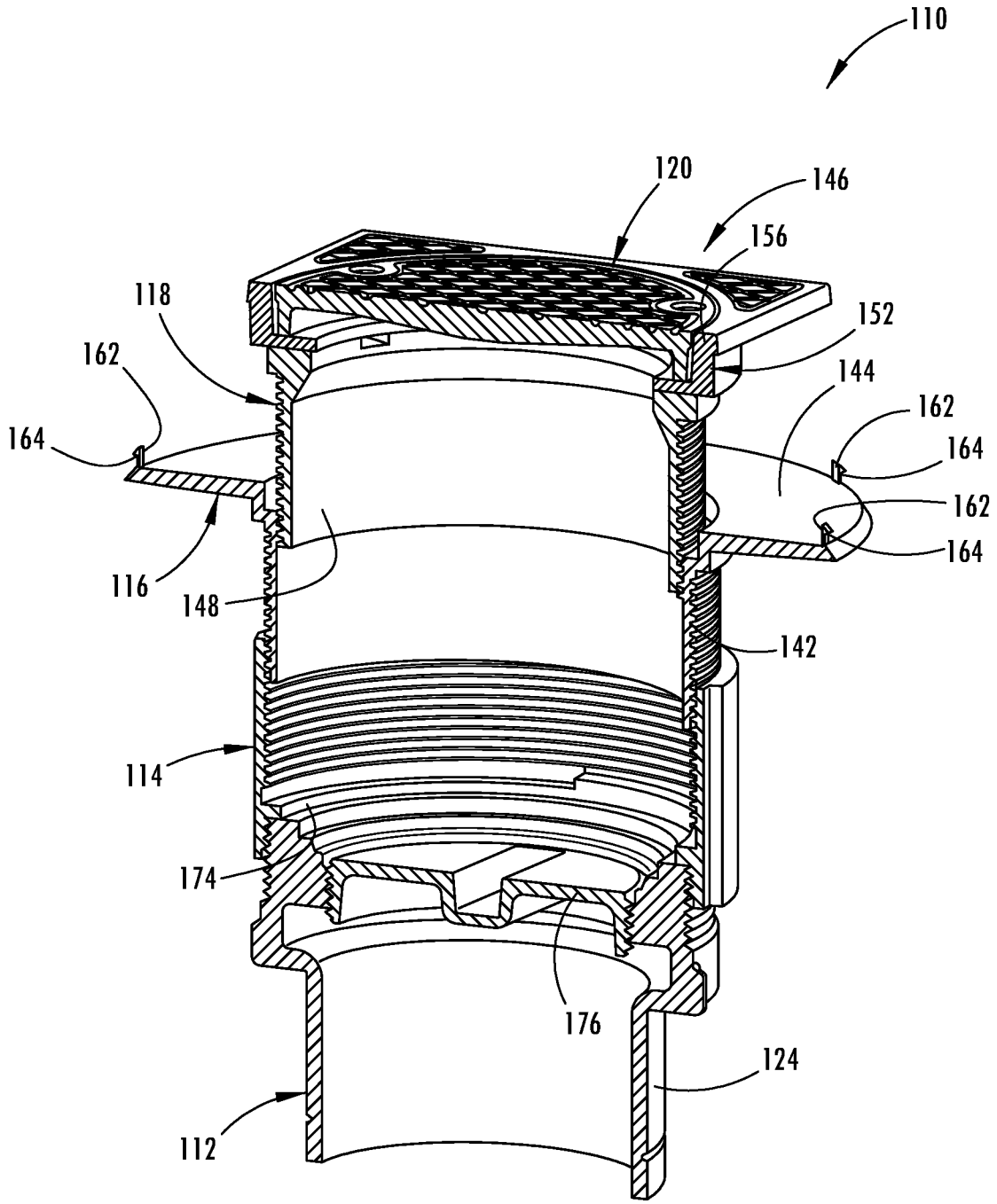
FIG. 9 is a cross-sectional view of the cleanout assembly seen in FIG. 7 with the construction cover removed in the assembly in its tallest height adjusted position.

FIG. 7-9 illustrate an adjustable cleanout assembly 110 embodying the principles of the present invention. The cleanout assembly 110 includes numerous components that correspond to the components of the previously discussed floor drain assembly 10. For example, the cleanout assembly 110 includes a ferrule 112, a rough-in adapter 116, an adjustable frame assembly 118 and a cleanout cover 120. Rather than a collar bolted to the drain body 12 as illustrated in FIGS. 1-6, the cleanout assembly 110 includes a coupling 114 to attach the other components to the ferrule 112. The coupling 114 itself is threadably attached to the ferrule 112.

As seen in FIG. 7, the coupling 114 has a generally round, cylindrical construction with the bottom end of the coupling 114 having internal threads that engage external threads provided on the ferrule 112. Immediately above the internal threads, on the interior side of the coupling 114, a ring 174 projects inwardly and extends circumferentially around the coupling 114. The ring 174 limits the depth to which the coupling 114 can be threaded down upon the ferrule 112.

Above the ring 174, the coupling 114 includes internal threads that engage external threads provided on a shank 142 of the rough-in adapter 116. Internally, the shank 142 is also threaded. The internal threads of the shank 142 of the rough-in adapter 116 engage external threads on the shank 148 of the adjustable frame assembly 118. In the illustrated embodiment of FIG. 7-9, the adjustable frame assembly 118 is illustrated as a multi-component structure, as opposed to a unitary/one-piece structure illustrated in FIGS. 1-6.

Like the previously discussed constructions, the adjustable frame assembly 118 includes a rim 152 having a land 154 and a lip 156. The land 154 receives and supports the cleanout cover 120. As an alternative design of the construction, which could be employed in the embodiments of FIGS. 1-6, the rim 152 of the adjustable frame assembly 118 defines a shape that is different from the shape of the cleanout cover 120. As seen in FIG. 7-9, the perimeter of the adjustable frame assembly 146 defines a square while the rim 152, and the perimeter of the cleanout cover 120 itself, are round.

The rough-in adapter 116, like the earlier constructions, includes a radially extending flange 144 located beneath the adjustable frame assembly 118. The flange 144 extends a distance such that the outer extent or perimeter of the flange 144 is radially beyond the outer extent or perimeter of the adjustable frame assembly 118, as measured from a central axis extending upwardly through an outlet coupling 124 of the ferrule 112.

The combined cleanout cover and adjustable frame assembly 146 is enclosed within the cleanout assembly 110 by engagement of a construction cover 122 with the rough-in adapter 116. More specifically, a perimetric sidewall 158 extends downwardly from a generally planar top wall 160 of the construction cover 122. About its lower end, the perimetric sidewall 158 is attached to the flange 144, thereby securing the construction cover 122 to the rough-in adapter 116.

Attachment of the perimetric sidewall 158 to the flange 144 is achieved in the manner previously described with prior constructions. Tabs 162, provided at spaced apart locations about the perimeter of the flange 144, extend upwardly and include an outwardly stepped tooth 164 at their distal ends. At locations corresponding to the tabs 162, the inner surface of the perimetric sidewall 158 is provided with recesses 166 that receive the teeth 164 and retain the perimetric sidewall 158 in engagement with the perimeter of the flange 144.

Like the prior constructions, construction cover 122 includes slots 172 or other features enabling the construction cover 122 to be removed after installation thereby allowing the height of the combined cover and adjustable frame assembly 146 to be adjusted prior to installation of the final flooring.

Additionally, the cleanout assembly 110 further includes a plug 176 that is removably engaged with the inner diameter of the ferrule 112. The plug 176 is preferably threadably engaged with the inner diameter of the ferrule 112 and may be removed therefrom for cleanout purposes.

The cleanout assembly 110 is installed in the same manner as the floor drain assembly 10 described above. Accordingly, attention is directed to the above discussion regarding the adjusting of the rough-in adapter 116 and the pouring of the subfloor. Similarly, the construction cover 122 is removed, the height of the combined adjustable frame assembly and cleanout cover 146 is adjusted and the finish floor installed in the same manner as previously described in connection with the earlier constructions and the not be repeated in connection with the present construction.

Figure 10:
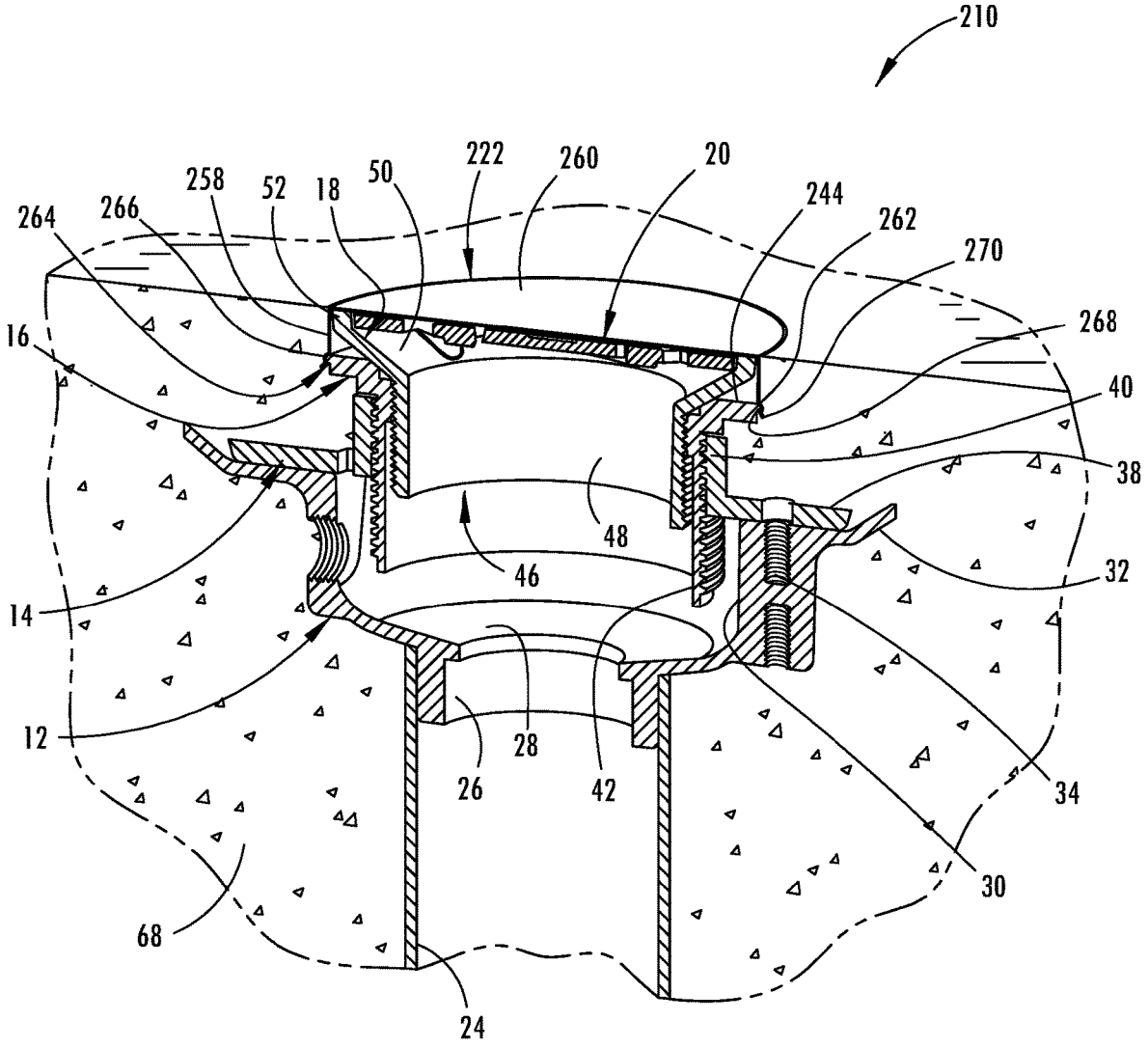
FIG. 10 is a cross-sectional view of another floor drain assembly embodying the principles of the present invention with a construction cover in place.
Figure 11:
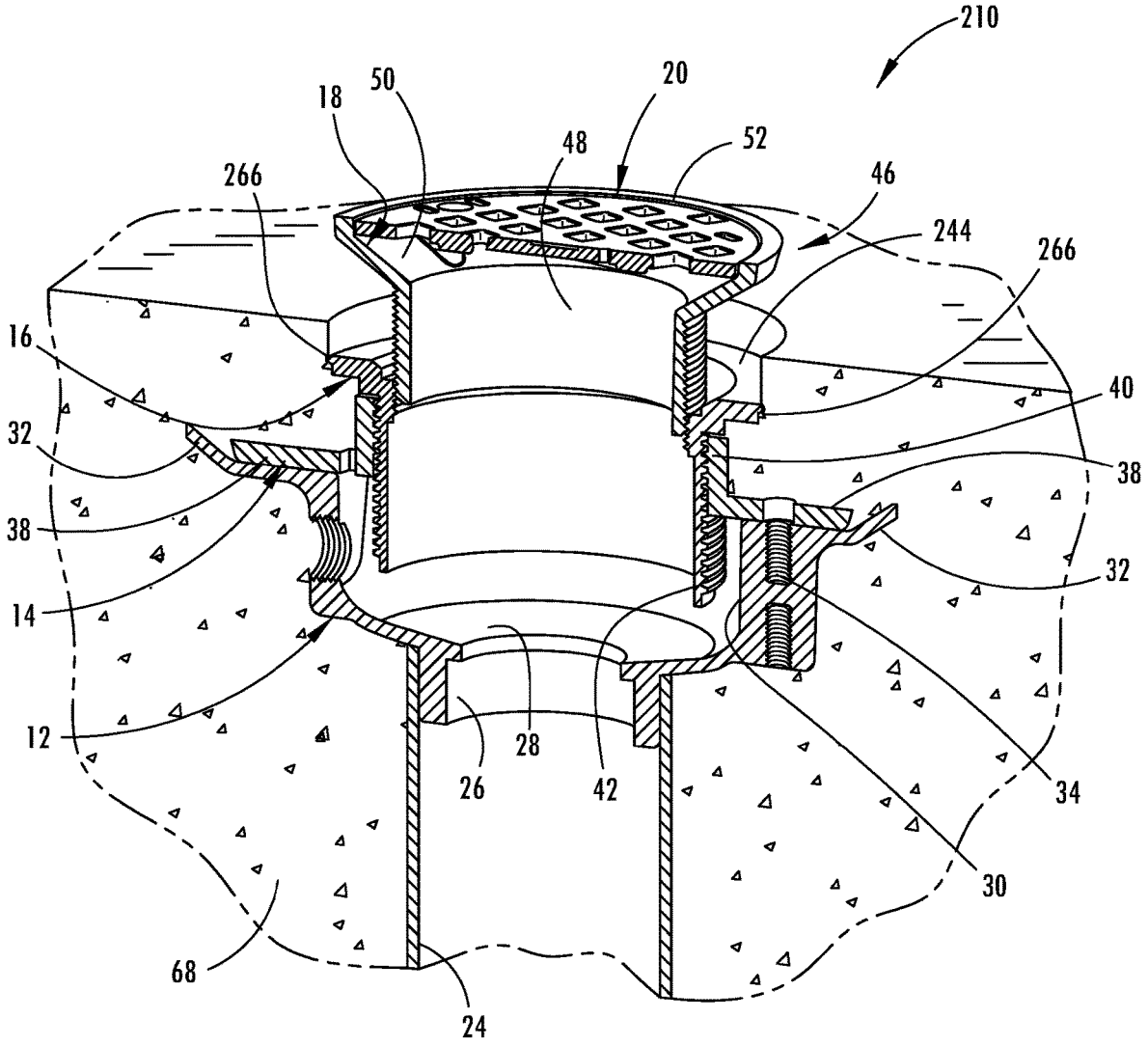
FIG. 11 is a cross-sectional view of the floor drain assembly seen in FIG. 10 with the construction cover removed and with strainer frame and strainer raised relative to the poured sub-floor.
Figure 12:
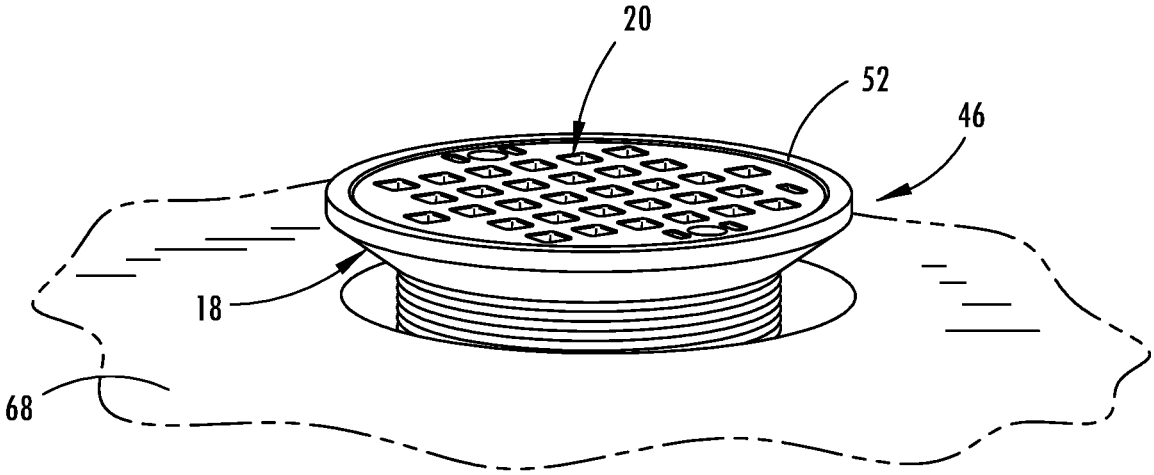
FIG. 12 is perspective view, similar to FIG. 11, showing the raised strainer frame and strainer from above the poured floor.

FIGS. 10-12 illustrate a floor drain assembly 210 that is identical to the construction of that seen in FIGS. 1-3, with the exception of the construction cover and the flange of the rough-in adapter. Accordingly, the floor drain assembly 210 includes a drain body 12, a collar 14 mounted to the drain body 12, a rough-in adapter 16 mounted to the collar 14, a strainer frame 18 mounted to the rough-in adapter 16, a strainer 20 mounted to the strainer frame 18, and a construction cover 222 cooperating with a flange 244 of the rough-in adapter 16 to enclose the strainer 20 and the strainer frame 18. Since the floor drain assembly 210 is substantially identical to the floor drain assembly 10 of FIGS. 1-3, only the differences in the construction are described in detail hereafter. For a detailed description of the drain body 12, the collar 14, the rough-in adapter 16 and its shank 42, the strainer frame 18, and the strainer 20, reference is herein made to the relevant portions of the description provided above in connection with FIGS. 1-3.

As with the prior construction, the rough-in adapter 16 is provided with an axially extending shank 42 and a radially extending flange 244 at the upper end of the shank 42. The flange 244 extends outwardly a distance such that the outer extent or perimeter of the flange 44 is slightly radially beyond the outer extent the rim 52 of the strainer frame 18, again, as measured from a central axis extending upwardly through the drain pipe 24 and the shank 48 of the strainer frame 18.

The drain head 46 is enclosed within the floor drain assembly 10 by engagement of the construction cover 222 with the rough-in adapter 16. More specifically, a perimetric sidewall 258 extends downward from a generally planar top wall 260, the latter having a shape substantially corresponding to the shape of the perimeter of the flange 244, and is attached to the perimeter of the flange 244, thereby securing the construction cover 222 to the rough-in adapter 16.

Attachment of the perimetric sidewall 258 to the flange 244 is achieved through a mated engagement of the lower end 262 of the perimetric sidewall 258 and the outer edge 264 of the flange 244. More specifically, the outer edge 264 or perimeter of the flange 244 is provided with an outwardly projecting rib 266. The contour of the rib 266 may vary, but is shown as being rounded or semi-circular. The lower end 262 of the perimetric sidewall 258 includes a correspondingly shaped recess or groove 268 within which the rib 266 is received in a mated engagement. Adjacent to the groove 268, the perimetric sidewall 258 is optionally provided with a lip 270, which flares radially outward and defines the terminal end of the perimetric sidewall 258.

To mount the cover 222 over the drain head 46, the cover 222 is positioned over the drain head 46 and pressed downward. During this downward movement, the lip 270 engages the rib 266 directing the perimetric sidewall 258 slightly outward and over the rib 266. The material from which the cover 222 is formed enables the lower end 262 to resiliently flex radially outward and over the rib 266 until the groove 268 is in alignment with the rib 266. At this point, the resiliency of the material allows the groove 268 to snap onto the rib 266 in mated engagement. Alternatively, the groove 268 may be sized relative to the rib 266 such that the groove 268 is pressed radially inward into mated engagement with and over the rib 266. With either engagement, the cover 222 is effectively retained over the drain head 46 on the rough-in adapter 16.

The cover 222 may be formed in a variety of ways from a variety of materials that allow for the above mentioned resilient engagement and retention. In a preferred embodiment, the cover 222 is constructed of vacuum formed polypropylene.

During pouring of the concrete subfloor 68, the floor drain assembly 210 is positioned on the drain pipe 24 and the height of the rough-in adapter 16 is adjusted such that the top of the subfloor 68 after pouring is at a height along the perimetric sidewall 258 below or flush with the planar top wall 260. After the subfloor 68 has cured, the construction cover 222 is designed to be removed, exposing the drain head 46.

The cover 222 may be removed through a variety of techniques. In one technique, the cover 222 is engage with a tool, such a screwdriver, and pried upwardly off of the remainder of the assembly 210. In another technique, is grasped near its perimeter, or elsewhere, and pulled upwardly off of the rough-in adapter 16. In a further technique, a tool with one or more prongs punctures the planar top wall 260 of the cover 222 so that the prongs extend through the openings of the strainer 20. The tool is then rotated thereby raising the drain head 46 relative to the rough-in adapter 16 and pulling the cover 222 off of the rough-in adapter 16. In this regard, the cover 222 may be semi-transparent or wholly transparent allowing a user to see the openings in the strainer 20 through the cover 222 or may including indicia in the top wall 260 corresponding the openings.

With the cover 222 removed, the height of the drain head 46 is adjusted and the finish floor installed. Any gap between the rim 52 and the finished floor may be filled with grout or another appropriate material.

While the cover 222 and modified of the flange 244 have been described in connection with a drain head having a round configuration, it will be readily appreciated that the rough-in adapter 16 of the embodiment seen in FIGS. 4-6 (with the square drain head) could have its flange similarly modified for use with the cover 222. It will further be appreciated that the rough-in adapter 116 of the clean-out assembly 110 seen in FIGS. 7-9 could have its flange 144 similarly modified for use with the cover 222. Such modifications and embodiments will be readily apparent to those skilled in the field of the present technology and are, therefore, within the scope of the present disclosure and the principles of the present invention without need for further description herein.

As a person skilled in the art will readily appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

I claim:

1. A floor drain assembly for connecting to a drain system of an installation site, the floor drain assembly comprising:

a drain body having outlet coupling adapted for connecting to the drain system and defining an axis;

a collar mounted to the drain body;

a rough-in adapter having a radially extending flange, the rough-in adapter being axially adjustably mounted to the collar;

a drain head axially adjustably mounted to the rough-in adapter; and a cover extending over the drain head, the cover including a central portion and a downwardly extending perimetric wall extending along an entire perimeter of the cover, a lower end of the perimetric wall being removably engaged to the flange of the rough-in adapter.

2. The floor drain assembly according to claim 1, wherein the cover is engaged with the flange of the rough-in adapter at an outer perimeter of the flange.

3. The floor drain assembly according to claim 1, wherein the cover extends about an outer perimeter of the flange of the rough-in adapter.

4. The floor drain assembly according to claim 1, wherein the engagement of the cover with the flange includes one or more resilient members.

5. The floor drain assembly according to claim 4, wherein the one or more resilient members are resilient toothed tabs.

6. The floor drain assembly according to claim 5, wherein the tabs are located on one of the flange and the cover.

7. The floor drain assembly according to claim 6, wherein the tabs engage recesses on the other of the flange and the collar.

8. The floor drain assembly according to claim 1, wherein the engagement of the cover to the flange is a form fit mated engagement.

9. The floor drain assembly according to claim 8, wherein the mated engagement includes a rib received within a groove.

10. The floor drain assembly according to claim 9, wherein the rib is formed on the flange and the groove is formed on the cover.

11. The floor drain assembly according to claim 9, wherein the rib extends in a circumferential direction about the perimeter of one of the flange and the cover.

12. The floor drain assembly according to claim 9, wherein the rib extends in a circumferential direction about a least a portion of the perimeter of one of the flange and the cover.

13. The floor drain assembly according to claim 9, wherein the rib extends in a circumferential direction about the entire perimeter of one of the flange and the cover.

14. The floor drain assembly according to claim 1, wherein the cover is retainingly engaged with the flange along the entire outer perimeter of the flange.

15. The floor drain assembly according to claim 1, wherein the cover includes a tool engagement recess formed in the central portion.

16. The floor drain assembly according to claim 1, wherein the cover includes a tool engagement recess formed adjacent to an outer perimeter of the central portion.

17. The floor drain assembly according to claim 1, wherein the cover is transparent.

18. The floor drain assembly according to claim 1, wherein the cover is semi-transparent.

19. The floor drain assembly according to claim 1, wherein the cover is wholly transparent.

* * * * *